US010904679B2

(12) United States Patent
As'ad et al.

(10) Patent No.: US 10,904,679 B2
(45) Date of Patent: Jan. 26, 2021

(54) METHOD FOR ENHANCING SIGNAL DIRECTIONALITY IN A HEARING INSTRUMENT

(71) Applicant: SIVANTOS PTE. LTD., Singapore (SG)

(72) Inventors: Hala As'ad, Nepean (CA); Martin Bouchard, Cantley (CA); Homayoun Kamkar-Parsi, Erlangen (DE)

(73) Assignee: Sivantos Pte. Ltd., Singapore (SG)

( * ) Notice: Subject to any disclaimer, the term of this patent is extended or adjusted under 35 U.S.C. 154(b) by 0 days.

(21) Appl. No.: 16/450,009

(22) Filed: Jun. 24, 2019

(65) Prior Publication Data

US 2019/0394580 A1 Dec. 26, 2019

(30) Foreign Application Priority Data

Jun. 22, 2018 (EP) ..... 18179323

(51) Int. Cl.
*H04R 25/00* (2006.01)
*H04S 7/00* (2006.01)

(52) U.S. Cl.
CPC ..... *H04R 25/505* (2013.01); *H04R 25/552* (2013.01); *H04S 7/303* (2013.01); *H04S 2420/01* (2013.01)

(58) Field of Classification Search
CPC ..... H04R 25/505; H04R 25/552; H04S 7/303; H04S 2420/01
USPC ..... 381/313
See application file for complete search history.

(56) References Cited

U.S. PATENT DOCUMENTS 8,199,949 B2 * 6/2012 Fischer ..... H04R 25/407 381/313
8,358,796 B2 * 1/2013 Puder ..... G10L 21/0208 381/313
2001/0031053 A1 * 10/2001 Feng ..... H04R 25/407 381/92
2003/0231773 A1 12/2003 Drtina
2006/0120535 A1 6/2006 Puder

FOREIGN PATENT DOCUMENTS

EP 2928210 A1 10/2015
WO 2009102811 A1 8/2009

* cited by examiner

*Primary Examiner* — Phylesha Dabney
(74) *Attorney, Agent, or Firm* — Laurence A. Greenberg; Werner H. Stemer; Ralph E. Locher

(57) ABSTRACT

A method for enhancing a signal directionality in a hearing instrument wherein first and second signals are generated by first and second input transducers that are spaced apart from one another. A first directional signal is derived from the first input signal and the second input signal by applying a second-to-first relative transfer function with respect to a first target angle to the second input signal. The second-to-first relative transfer function is a relative transfer function from the second input transducer to the first input transducer with respect to the first target angle. Similarly, a second directional signal is derived from the second input signal and the first input signal by applying a first-to-second relative transfer function with respect to a second target angle to the first input signal. An angle-enhanced signal is derived from the first directional signal and the second directional signal.

14 Claims, 2 Drawing Sheets

METHOD FOR ENHANCING SIGNAL DIRECTIONALITY IN A HEARING INSTRUMENT

CROSS-REFERENCE TO RELATED APPLICATION

This application claims the priority, under 35 U.S.C. § 119, of European application EP 18179323.3-1210, filed Jun. 22, 2018; the prior application is herewith incorporated by reference in its entirety.

BACKGROUND OF THE INVENTION

Field of the Invention

The invention is related to a method for enhancing a signal directionality in a hearing instrument. The method includes the following steps: generating a first input signal by means of a first input transducer of the hearing instrument and a second input signal by means of a second input transducer of the hearing instrument, the second input transducer being spaced apart from the first input transducer, deriving a first directional signal from the first input signal and the second input signal, deriving a second directional signal from the second input signal and the first input signal, and deriving an angle-enhanced signal from the first directional signal and the second directional signal.

Hearing impaired listeners face challenges in understanding the target speakers in complex noisy environments with directional interfering speakers and diffuse-like background noise. Hearing aids with microphone arrays have been introduced as a promising solution in order to achieve a design with directionally sensitive responses that selectively preserve or attenuate sources based on their directions of arrivals.

In order to improve the desired speech-to-noise ratio, as a first approach a non-adaptive first-order Differential Microphone Array (DMA) is known. Assuming the availability of two closely-spaced microphones, a delayed version of the second microphone input signal is subtracted from the first microphone input signal to produce the DMA output. In DMA, a fixed time delay is used. This time delay depends on the distance between the microphones and the speed of sound in free field environment (approx. 343 m/s). The time delay plays an important role in determining the direction of nulls in the back hemisphere, taking the first microphone's position as a reference for the frontal direction.

In order to cancel the interfering signal from different directions, there is a need to adjust the runtime difference distance between the available microphones. As the distance is typically fixed, the parameter to be adjusted is the delay, leading to an Adaptive Differential Microphone Array (ADMA).

In real life situations, there is a need to adjust the time delay in order to adaptively adjust the direction of the null in the back hemisphere and to cancel the interference signals from different desired directions. Therefore, the non-adaptive DMA is not suitable in real life situations under non-stationary conditions. As a result, an Adaptive Differential Microphone Array (ADMA) with an adaptive adjustment of the delay between the input signals of the two microphones has been introduced. The ADMA has a distortion-free response at 0 degree, i.e., in the axis direction from the second to the first microphone. However, it may lead to a distorted response, e.g. in terms of attenuation or even phase distortion, if the target signal arrives from other directions.

SUMMARY OF THE INVENTION

It is therefore an object of the invention to provide a method for enhancing a signal directionality, i.e., speech intelligibility and signal-to-noise ratio (SNR) in a desired, especially non-frontal direction in a hearing instrument without generating additional target or phase distortion.

With the above and other objects in view there is provided, in accordance with the invention, a method of enhancing a signal directionality in a hearing instrument, the method comprising:

generating a first input signal by a first input transducer of the hearing instrument and a second input signal by a second input transducer of the hearing instrument, wherein the second input transducer spaced from the first input transducer;

providing a first target angle and a second target angle, deriving a first directional signal from the first input signal and the second input signal by applying a second-to-first relative transfer function with respect to the first target angle to the second input signal, the second-to-first relative transfer function being a relative transfer function from the second input transducer to the first input transducer with respect to the first target angle; deriving a second directional signal from the second input signal and the first input signal by applying a first-to-second relative transfer function with respect to the second target angle to the first input signal, the first-to-second relative transfer function being a relative transfer function from the first input transducer to the second input transducer with respect to the second target angle; and deriving an angle-enhanced signal from the first directional signal and the second directional signal.

In other words, the above and other objects are achieved by a method for enhancing a signal directionality in a hearing instrument, the method comprising the steps of: generating a first input signal by means of a first input transducer of the hearing instrument and a second input signal by means of a second input transducer of the hearing instrument, the second input transducer being spaced apart from the first input transducer, providing a first target angle and a second target angle, deriving a first directional signal from the first input signal and the second input signal by applying a second-to-first relative transfer function to the second input signal, wherein the second-to-first relative transfer function is taken as the relative transfer function from the second input transducer to the first input transducer with respect to the first target angle, deriving a second directional signal from the second input signal and the first input signal by applying a first-to-second relative transfer function to the first input signal, wherein the first-to-second relative transfer function is taken as the relative transfer function from the first input transducer to the second input transducer with respect to the second target angle, and deriving an angle-enhanced signal from the first directional signal and the second directional signal. Embodiments of particular advantage and inventiveness on their own are explained in the dependent claims and in the following description.

In particular, the term "signal directionality" shall comprise a sensitivity of the signal with respect to a change of a direction of a sound source, e.g., the possibility to focus the signal's response onto a given test sound source at a desired angle, and the degree of the focus, which are measurable in terms of SNR or SNR improvement for a given test sound level from the desired angle and a given background noise level. In this sense, enhancing a signal directionality shall comprise an improvement in these terms, i.e., an SNR improvement for a given situation.

The term "hearing instrument" refers to any kind of instrument configured and adapted to receive an environmental or ambient sound and output any form of processed sound corresponding to the sound, wherein the processing can be directed at any form of enhancement of the properties of the environment sound or some of its signal components. In this vein, the hearing instrument may, in particular, be a hearing aid that is configured to compensate for a person's hearing loss, but also another type of instrument such as those that are used in communication technology.

The term "input transducer" refers to any device configured and adapted to convert an ambient sound into an electrical signal using some physical effect, e.g., a microphone. In particular, the first and the second input transducer may each be an omnidirectional microphone. The first input signal in that case may be the electrical signal generated by the first input transducer from the ambient sound, or it may be the generated electrical signal which has been subjected to pre-processing, e.g., in terms of digitalization and/or dynamical range compression and/or pre-amplification and the like. The same definitions and reasonings may apply to the second input signal. The first input transducer is to be understood as spaced apart from the second input transducer whenever there is an acoustical runtime difference between the two transducers which is above the minimum time resolution of the hearing instrument. Preferably, the two input transducers are disposed in one common housing of the hearing instrument or of one of the components of the hearing instrument.

The first and/or the second target angle in particular may be provided by means of the first input signal and/or the second input signal, e.g., by some sound source direction estimation process which employs the first and/or the second input signal or at least one signal derived there from as an input for the estimation. Likewise, the first and/or the second target angle may be provided adaptively from an intermediate signal of the proposed method, e.g., by means of the first and/or the second directional signal or by means of the angle-enhanced signal. The notion of target angle, in this context shall be understood of a preferred direction for further signal processing, and is not necessarily restricted to the angle direction of a sound source as a given target, but may also refer to a null direction of the respective directional signal.

The relative transfer function from the second input transducer to the first input transducer with respect to a given angle, such as the first target angle, is the transfer function that has to be applied to the second input transducer's signal—i.e., the second input signal—in order to obtain the first input transducer's signal—i.e., the first input signal—given the assumption of a localized sound source at the given angle as the only signal present. In this sense, in time domain or in time-frequency domain, the second-to-first relative transfer function is given by the first input transducer's transfer function with respect to first target angle divided by the second input transducer's transfer function with respect to the first target angle. The same definitions and reasonings, mutatis mutandis, may apply to the first-to-second relative transfer function.

By design, the first directional signal is a combination, preferably a difference, of the first input signal as generated by means of the first input transducer, and the first input signal as it would be if there would be present only one signal source at the first target angle. In this sense, the first directional signal can be designed as a signal with its signal contributions from the first target angle and an angle range about the first target angle being suppressed, and the second directional signal can be designed to have the signal contributions from an angle range about the second target angle suppressed.

Thus, by deriving the angle-enhanced signal from the first and the second directional signal, due to the possibility to suppress—in the ideal case, totally—contributions from the second target angle in the second directional signal, the angle-enhanced signal may be designed in a way that no attenuation is applied to a sound signal impinged onto the first and the second input transducer from the second target angle, while by adjusting the first target angle and the way of combining the first directional signal and the second directional signal—via, e.g., a linear mixing factor for the second directional signal—the contributions from specific noise sources may be attenuated in the angle-enhanced signal.

Preferably, the relative transfer function from the second input transducer to the first input transducer is derived as a head-related transfer function of the first input transducer divided by a head-related transfer function of the second input transducer, and the relative transfer function from the first input transducer to the second input transducer is derived as the head-related transfer function of the second input transducer divided by the head-related transfer function of the first input transducer. To this end, the hearing instrument preferably is to be worn by a user at his/her head, in particular at one ear or at both ears. This may be the case for a hearing instrument given by a monaural hearing aid or a binaural hearing aid system, wherein the first and second input transducer are both disposed in the monaural hearing aid, or are each disposed in one single-side hearing device of the binaural hearing aid system.

For the first directional signal, the relative transfer function from the second input transducer is taken as the head-related transfer function of the first input transducer taken at the first target angle, decided by the head-related transfer function of the second input transducer, likewise taken at the first target angle. The head-related transfer function (HRTF) of an input transducer takes into account shadowing and refracting effects of the head and even of the pinna which may affect the propagation of sound towards the transducer disposed at a fixed position on the head, wherein the head's influence on the propagation of sound towards the input transducer may be highly angle-dependent. Thus, for a hearing instrument comprising a first and a second input transducer, the hearing instrument to be worn by a user at a fixed position on his/her head, taking into account the shadowing and refraction effects cited above helps to create a realistic angle-enhanced signal, as not only a propagating sound's runtime difference and delay between the two input transducers is take into account for enhancing the directionality, but also the effects described above which may lead to a deviation of a directional signal from the theoretical model, thus possibly deteriorating the directionality of the final signal.

Preferably, the HRTF of the first input transducer and/or the HRTF of the second input transducer is/are derived by means of an angle-dependent measurement using a head simulator. Preferably, the head simulator also comprises a simulation of a pinna during the measurement. The measurement may be performed by, e.g., measuring the response and/or sensitivity of the first input transducer and of the second input transducer to a test sound signal with a defined sound pressure level per measurement cycle, the sound source of the test sound signal being at a fixed distance to the hearing device but with variable angle. The test sound signal may be tuned through different sound pressure levels for a series of measurement cycles in order to obtain a realistic HRTF for a broad range of sound propagation dynamics. As the HRTF is a function of frequency when applied in frequency domain or time-frequency domain, preferably a scan through the whole frequency range of interest is performed for a multiplicity of angular positions, giving the possibility to continuously interpolate the missing angular positions and/or missing frequencies if a discredited scan is performed.

In an embodiment, the HRTF of the first input transducer and/or the head-related transfer function of the second input transducer is/are derived by means of an angle-dependent measurement on a human head. This gives the possibility to take into account the specific anatomy of a hearing instrument's user and its consequences on the propagation of sound near the ear and, particularly, the pinna.

In an embodiment, in frequency-domain or in time frequency domain the first directional signal is derived as the first input signal subtracted by the product of the second directional signal and the second-to-first relative transfer function with respect to the first target angle, and/or the second directional signal is derived as the second input signal subtracted by the product of the first directional signal and the first-to-second relative transfer function with respect to the second target angle. In this sense, any symmetrical signal pre-processing applied in an equivalent way to each of the signals generated directly by the first input transducer and the second input transducer, respectively, shall be understood to be incorporated in the first and the second input signal, respectively. The first and second directional signals are the HRTF-equivalent of a cardioid signal with a null in the direction of the first or the second target angle, respectively.

In an embodiment, the angle-enhanced signal is derived by means of a sum of the first directional signal and the product of the second directional signal and a weighting factor. This means that the contribution from a sound source located direction of the null of the second directional signal, i.e., the second target angle, is fixed by the contribution of said sound source to first directional signal. This allows for designing an angle-enhanced signal with an optimal sensitivity in the direction of the second target angle, by optimizing the weighting factor with respect to a proper boundary condition such as, preferably, the minimal power of the angle-enhanced signal.

In an embodiment, the first input transducer and the second input transducer define a preferred direction and a distribution of space into a front hemisphere and a rear hemisphere, the first target angle is provided within the back hemisphere, and/or the second target angle is provided within the front hemisphere. If the hearing instrument is to be worn on a user's head, preferably the front and back hemispheres are to be chosen such that they coincide with the corresponding spatial configuration of the user's environment with respect to his perception. Providing the second target angle within the front hemisphere then allows for generating an angle-enhanced signal with a particular sensitivity in the direction of the second target angle, which may be desirable when a speaker is positioned in the front hemisphere of the user in a non-frontal direction. The choice of the first target angle in the back hemisphere allows for eliminating directed noise from the back hemisphere.

In an embodiment, a filtered angle-enhanced signal is derived from the angle-enhanced signal by means of a compensation filter for obtaining a distortionless response in phase and magnitude for a sound source in any direction in the front hemisphere, i.e., for any second target angle. Preferably, the compensation filter has a low-pass filter characteristic. Advantageously, by construction the transfer function of the compensation filter may depend on the second-to-first relative transfer function, especially with respect to the first target angle, and/or on the first-to-second relative transfer function, especially with respect to the second target angle.

In particular, in case the first directional signal $C_1$ and the second directional signal $C_2$ in time-frequency-domain are given by $$C_1(k,n)=Y_1(k,n)-H_{2\to1}(k,\alpha_1)\cdot Y_2(k,n),$$

$$C_2(k,n)=Y_2(k,n)-H_{1\to2}(k,\alpha_2)\cdot Y_1(k,n),$$

wherein k is a discrete frequency index and n is a discrete time index, $Y_1$ denotes the first input signal, $Y_2$ denotes the second input signal, $\alpha_1$ denotes the first target angle, $\alpha_2$ denotes the second target angle, $H_{1\to2}$ is the first-to-second relative transfer function, and $H_{2\to1}$ is the second-to-first relative transfer function, and the angle-enhanced signal Z is given by $$Z(k,n)=(k,n)-\lambda(k,n)\cdot C_2(k,n)$$

with the weighting factor $\lambda$(k,n), then a low-pass filter may be applied as $$Z'(k,n)=Z(k,n)/[1-H_{2\to1}(k,\alpha_1)\cdot H_{1\to2}(k,\alpha_2)+u]$$

in order to obtain the filtered angle-enhanced signal Z' (k,n). Here, u is a positive regularization constant, preferably taken as small as possible.

In an embodiment, the first input signal and the second signal are provided by the first input transducer and the second input transducer, respectively, of a monaural hearing aid. The proposed method is of particular advantage in a monaural hearing aid as hearing instrument, since directional signal processing such as noise reduction and speech enhancement are key techniques in order to improve a hearing perception for a hearing impaired user of a hearing aid. Furthermore, due to the small distance between the input transducers in monaural hearing aids, directional signal processing and beam forming techniques are particularly challenging.

In an alternative embodiment, the first input signal and the second signal are provided by the first input transducer and the second input transducer, respectively, of a first single-side hearing device of a binaural hearing aid system, and the angle-enhanced signal or the filtered angle-enhanced signal of the first single-side hearing device is used with a signal of a second single-side hearing device of the binaural hearing device for providing a binaural beamformer signal. Preferably, also the signal of the second single-side hearing device is an angle-enhanced signal or a filtered angle-enhanced signal obtained according to the proposed method. In particular, this means that the proposed method is employed as a monaural pre-processing step for a binaural beamforming step in a binaural hearing aid, e.g., for a constraint-based binaural beamforming or for a binaural beamforming by weighted sums of the monaurally pre-processed signals of each single-side hearing device. This pre-processing step takes into account that even in binaural beam forming, there typically exists a preferred forward direction and a need for eliminating noise from the back hemisphere, which can be treated monaurally. Furthermore, all signal processing done monaurally does not require data transmission between the single-side hearing devices of the binaural hearing aid system, thus helping to reduce the latency due to saved transmission protocol time and to save battery power.

The invention further provides a hearing instrument, the hearing instrument comprising a first input transducer and a second input transducer for providing a first input signal and a second input signal, respectively, from a sound signal of an environment, and a signal processing unit configured to perform the method described above. The advantages of the proposed method for enhancing a signal directionality in a hearing instrument and for its preferred embodiments can be transferred to the hearing instrument itself in a straight forward manner. The hearing instrument in particular may be configured as a monaural hearing aid, or as a single-side hearing device of a binaural hearing aid system.

Other features which are considered as characteristic for the invention are set forth in the appended claims.

Although the invention is illustrated and described herein as embodied in a method for enhancing a signal directionality in a hearing instrument, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE SEVERAL VIEWS OF THE DRAWING

Parts and variables corresponding to one another are provided with the same reference numerals in each case of occurrence for all figures.

DETAILED DESCRIPTION OF THE INVENTION

Figure 1:
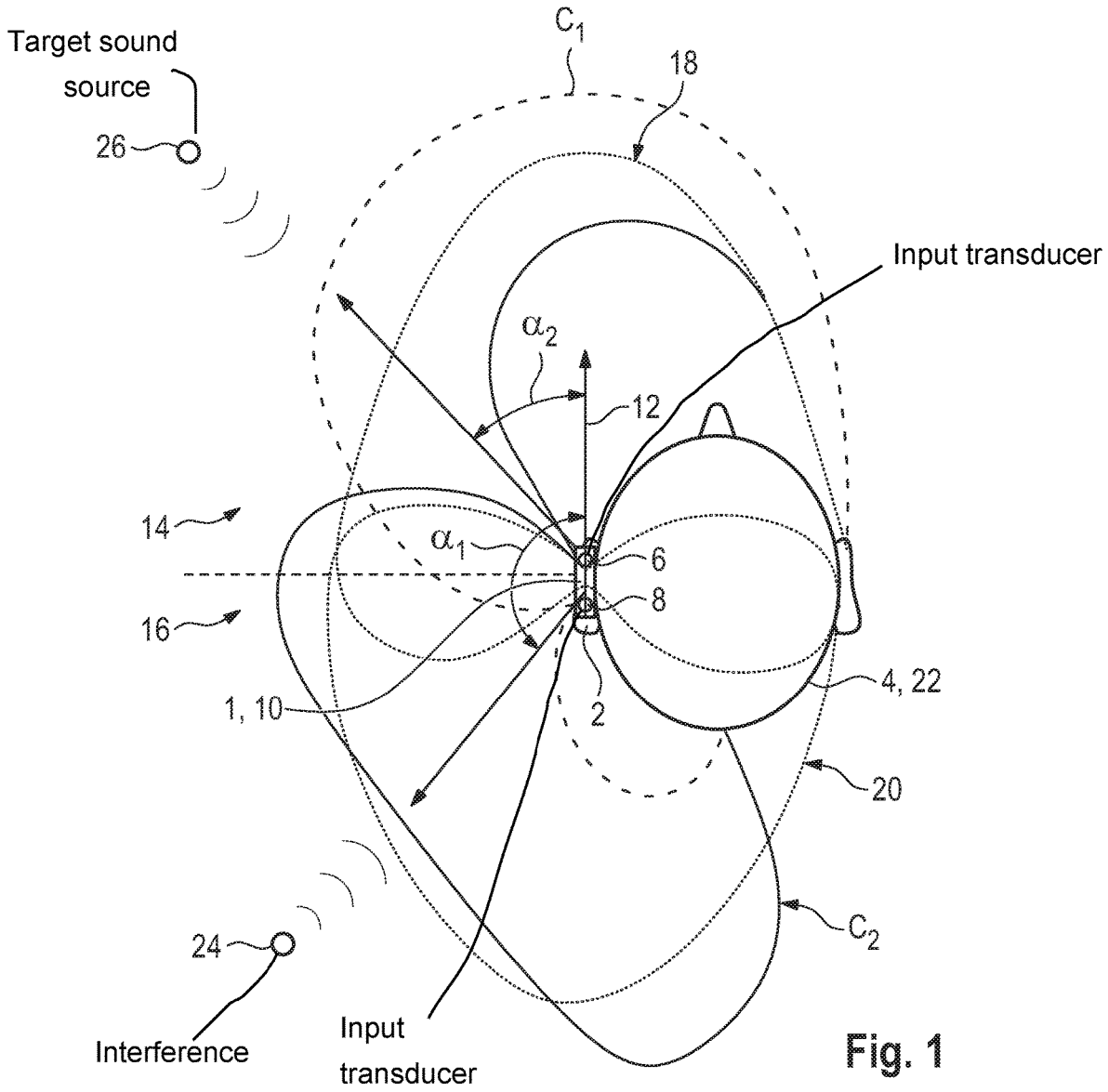
FIG. 1 is a schematic top view of a hearing instrument worn by a user in a situation with a target sound source and an unwanted interference.

Referring now to the figures of the drawing in detail and first, particularly, to FIG. 1 thereof, there is shown a schematic top view of a hearing instrument embodied by a monaural hearing aid 1 which is worn on/in the left ear 2 of a user 4. The hearing aid 1 in this case is a "behind-the-ear" instrument (BTE), comprising a first input transducer 6 and a second input transducer in the hearing aid body 10 which is worn by the user 4 above and behind his left ear 2. The first input transducer 6 and the second input transducer 8 define a direction of preference 12, i.e., the frontal direction of the user 4. In particular, the direction of preference 12 establishes a front hemisphere 14 and a back hemisphere 16 of the user 4.

Normally, in order to produce a directional signal a forward cardioid signal 18 (pointed line) substantially covering the front hemisphere 14 and a backward cardioid signal 20 (pointed line) substantially covering the back hemisphere 16 are derived by time-delayed subtractions of the signals of the first and second input transducer 6, 8 (in the time domain), or by subtraction of a phase-shifted signal (in the frequency or time-frequency domain).

In order to achieve directional signals with null directions off the direction of preference 12, at least the delay (in the time domain) or the phase (in the frequency or time-frequency domain) has to be varied. Due to the presence of the head 22 of the user 4, however, said variation must also take into account the shadowing and refraction effects of the head 22. This leads to the use of the relative transfer function.

Assuming a situation in which an unwanted interference 24 of directed sound, as e.g., some directed noise source or a speaker of another conversation, is present in the back hemisphere 16 at a first target angle $\alpha_1$, and a target sound source 26, e.g. a speaker speaking to the user 4, is given at a second target angle $\alpha_2$ in the front hemisphere 14, one may design an angle-enhanced signal from the signals generated by the first and second input transducer 6, 8 such that the sensitivity in the direction of the target sound source 26, i.e., in the direction given by $\alpha_2$ is maximal, while there is a maximal attenuation and thus a minimal sensitivity in the direction of the interference 24.

To this end, a first directional signal $C_1$ and a second directional signal $C_2$ (represented by their directionality characteristics, displayed as dashed line for $C_1$ and solid line for $C_2$) are derived in a way still to be described. The first directional signal $C_1$ has its maximum attenuation in the direction of the interference 24, while the second directional signal $C_2$ has its maximal attenuation in direction of the target sound source 26.

This behavior for the first directional signal $C_1$ can be achieved by subtracting from a first input signal generated by the first input transducer—possibly after some pre-processing—a second input signal generated by the second input transducer—after equivalent pre-processing—the second input signal being filtered, i.e., in time or time frequency domain multiplied with the relative transfer function from the second input transducer 8 to the first input transducer 6 with respect to the first target angle $\alpha_1$. Applying said relative transfer function onto the second input signal generated by means of the second input transducer 8 is the signal that would be obtained at the first input transducer 6 if the noise from the interference 24 would be the only sound present. Thus, subtracting this signal from the true signal generated by means of the first input transducer 6 yields a notch in the back hemisphere. The relative transfer function is derived as a fraction of the HRTFs of the two input transducers 6, 8, thus taking into account the shadowing and refracting effects cited above.

Figure 2:
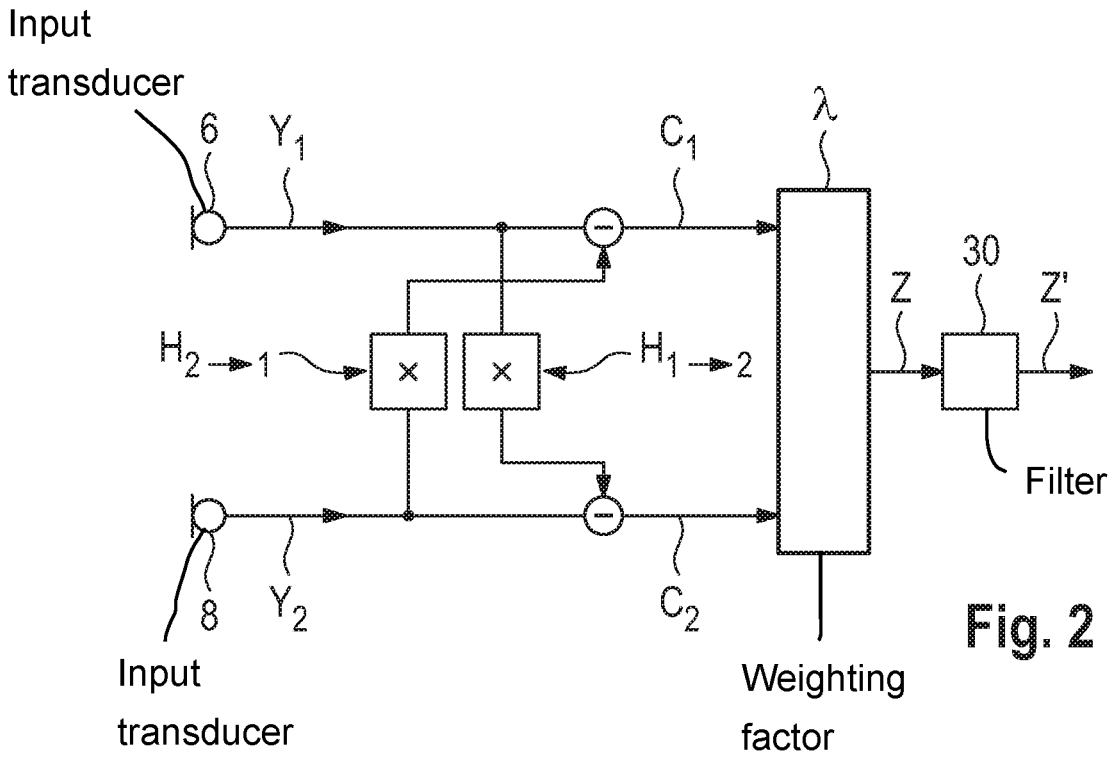
FIG. 2 is a schematic flow chart for generating an angle-enhanced signal in the situation of FIG. 1.

FIG. 2 schematically shows a flow chart of a method for enhancing the directionality of a signal of the hearing aid displayed in FIG. 1. The first input transducer 6 generates a first input signal $Y_1$, the second input transducer 8 generates a second input signal $Y_2$. Any type of pre-processing such as pre-amplification, digitalization or the like which is applied in an equivalent manner to each of the raw signals generated by the first input transducer 6 and the second input transducer 8 shall be incorporated into the first input signal $Y_1$ and the second input signal $Y_2$, respectively.

From the first input signal $Y_1$ and the second input signal $Y_2$, a first directional signal $C_1$ is generated by applying to the second input signal $Y_2$ the relative transfer function from the second input transducer 8 to the first input transducer 6 with respect to the first target angle $\alpha_1$, and subtracting the resulting signal from the first input signal $Y_1$. In time-frequency domain with discrete frequency and time indices k and n, respectively, this can be written as $$C_1(k,n)=(k,n)-H_{2\to1}(k,\alpha_1)\cdot Y_2(k,n),$$

with $H_{2\to1}$ (k, $\alpha_1$) denoting the above-mentioned relative transfer function with respect to the first target angle $\alpha_1$. Likewise, the second directional signal $C_2$ is given by $$C_2(k,n)=Y_2(k,n)-H_{1\to2}(k,\alpha_2)\cdot Y_1(k,n),$$

wherein $H_{1\to2}$ is the relative transfer function from the first input transducer 6 to the second input transducer 8 with respect to the second target angle $\alpha_2$ Then, an angle-enhanced signal Z can be derived as $$Z(k,n)=C_1(k,n)-\lambda(k,n)\cdot C_2(k,n)$$

with a weighting factor λ(k,n) chosen such that the total power of Z (k,n) is minimized. Applying a low-pass filter 30 to the angle-enhanced function Z may lead to a filtered angle-enhanced signal Z'. The filtered angle-enhanced signal Z' or the angle-enhanced signal Z may be used for further processing in the hearing aid 1, in particular for generating an output signal to be presented to the hearing of the user 4.

Once more in a generalized summary, the invention discloses a method for enhancing a signal directionality in a hearing instrument, the method comprising the steps of: generating a first input signal $Y_1$ by means of a first input transducer 6 of the hearing instrument 1 and a second input signal $Y_2$ by means of a second input transducer 8 of the hearing instrument 1, the second input transducer 8 being spaced apart from the first input transducer 6, providing a first target angle $\alpha_1$ and a second target angle $\alpha_2$, deriving a first directional signal $C_1$ from the first input signal $Y_1$ and the second input signal $Y_2$ by applying a second-to-first relative transfer function $H_{2\to1}$ with respect to the first target angle $\alpha_1$ to the second input signal $Y_2$, wherein the second-to-first relative transfer function $H_{2\to1}$ is taken as the relative transfer function from the second input transducer 8 to the first input transducer 6 with respect to the first target angle $\alpha_1$, deriving a second directional signal $C_2$ from the second input signal $Y_2$ and the first input signal $Y_1$ by applying a first-to-second relative transfer function $H_{1\to2}$ with respect to the second target angle $\alpha_2$ to the first input signal $Y_1$, wherein the first-to-second relative transfer function $H_{1\to2}$ is taken as the relative transfer function from the first input transducer 6 to the second input transducer 8 with respect to the second target angle $\alpha_2$, and deriving an angle-enhanced signal Z from the first directional signal $C_1$ and the second directional signal $C_2$.

Even though the invention has been illustrated and described in detail with help of a preferred embodiment example, the invention is not restricted by this example. Other variations can be derived by a person skilled in the art without leaving the extent of protection of this invention.

The following is a summary list of reference numerals and the corresponding structure used in the above description of the invention:

1 hearing instrument
2 (left) ear
4 user
6 first input transducer
8 second input transducer
10 hearing aid body
12 direction of preference
14 front hemisphere
16 back hemisphere
18 forward cardioid
20 backward cardioid
22 head
24 interference
26 target sound source
30 low-pass filter
$\alpha_{1/2}$ first/second target angle
$C_{1/2}$ first/second directional signal
$Y_{1/2}$ first/second input signal
Z angle-enhanced signal
Z' filtered angle-enhanced signal

The invention claimed is:

1. A method of enhancing a signal directionality in a hearing instrument, the method comprising:

generating a first input signal by a first input transducer of the hearing instrument and a second input signal by a second input transducer of the hearing instrument, wherein the second input transducer spaced from the first input transducer;

providing a first target angle and a second target angle, deriving a first directional signal from the first input signal and the second input signal by applying a second-to-first relative transfer function with respect to the first target angle to the second input signal, the second-to-first relative transfer function being a relative transfer function from the second input transducer to the first input transducer with respect to the first target angle;

deriving a second directional signal from the second input signal and the first input signal by applying a first-to-second relative transfer function with respect to the second target angle to the first input signal, the first-to-second relative transfer function being a relative transfer function from the first input transducer to the second input transducer with respect to the second target angle; and deriving an angle-enhanced signal from the first directional signal and the second directional signal;

wherein the second-to-first relative transfer function is given by a transfer function of the first input transducer with respect to the first target angle divided by a transfer function of the second input transducer; and wherein the first-to-second relative transfer function is given by the transfer function of the second input transducer with respect to the second target angle divided by the transfer function of the first input transducer.

2. The method according to claim 1, which comprises:

deriving the relative transfer function from the second input transducer to the first input transducer as a head-related transfer function of the first input transducer divided by a head-related transfer function of the second input transducer; and deriving the relative transfer function from the first input transducer to the second input transducer as the head-related transfer function of the second input transducer divided by the head-related transfer function of the first input transducer.

3. The method according to claim 2, which comprises deriving one or both of the head-related transfer function of the first input transducer and the head-related transfer function of the second input transducer by way of an angle-dependent measurement using a head simulator.

4. The method according to claim 2, which comprises deriving one or both of the head-related transfer function of the first input transducer and the head-related transfer function of the second input transducer by way of an angle-dependent measurement on a human head.

5. The method according to claim 1, which comprises: in a frequency-domain or in a time frequency domain, performing at least one step selected from the group consisting of:

deriving the first directional signal as the first input signal subtracted by a product of the second directional signal and the second-to-first relative transfer function with respect to the first target angle, and deriving the second directional signal as the second input signal subtracted by a product of the first directional signal and the first-to-second relative transfer function with respect to the second target angle.

6. The method according to claim 1, wherein the step of deriving the angle-enhanced signal comprises forming a sum of the first directional signal and the product of the second directional signal and a weighting factor.

7. The method according to claim 6, which comprises determining the weighting factor by minimizing a signal energy of the angle-enhanced signal.

8. The method according to claim 1, which comprises deriving a filtered angle-enhanced signal by subjecting the angle-enhanced signal to a compensation filter.

9. The method according to claim 1, wherein the first input transducer and the second input transducer define a preferred direction and a division of space into a front hemisphere and a back hemisphere, and wherein the method is performed with at least one condition selected from the group consisting of:

the first target angle lies within the back hemisphere, and the second target angle lies within the front hemisphere.

10. The method according to claim 1, wherein the hearing instrument is a monaural hearing aid and the method comprises acquiring the first input signal and the second input signal by the first input transducer and the second input transducer, respectively, of the monaural hearing aid.

11. The method according to claim 1, which comprises:

providing the first input signal and the second input signal by the first input transducer and the second input transducer, respectively, of a first single-side hearing device of a binaural hearing aid system; and using the angle-enhanced signal or the filtered angle-enhanced signal of the first single-side hearing device with a signal of a second single-side hearing device of the binaural hearing device for providing a binaural beamformer signal.

12. A hearing instrument, comprising:

a first input transducer for acquiring a first input signal and a second input transducer for acquiring a second input signal, respectively, from an ambient sound signal; and a signal processing unit configured to perform the method according to claim 1.

13. The hearing instrument according to claim 12 configured as a monaural hearing aid.

14. The hearing instrument according to claim 12 configured as a single-side hearing device of a binaural hearing aid system.

* * * * *